US008211205B1

(12) United States Patent
Didenko et al.

(10) Patent No.: US 8,211,205 B1
(45) Date of Patent: Jul. 3, 2012

(54) METHOD OF CONTROLLED SYNTHESIS OF NANOPARTICLES

(75) Inventors: Yuri Trofimovich Didenko, Savoy, IL (US); Yuhua Ni, Champaign, IL (US)

(73) Assignee: UT Dots, Inc., Champaign, IL (US)

( * ) Notice: Subject to any disclaimer, the term of this patent is extended or adjusted under 35 U.S.C. 154(b) by 437 days.

(21) Appl. No.: 12/462,014

(22) Filed: Jul. 28, 2009

(51) Int. Cl.
*B22F 9/24* (2006.01)

(52) U.S. Cl. ..... 75/371; 75/373; 977/896

(58) Field of Classification Search ..... None
See application file for complete search history.

(56) References Cited

U.S. PATENT DOCUMENTS 7,208,439 B2 * 4/2007 Zhong et al. ..... 502/185
7,335,245 B2 * 2/2008 He et al. ..... 75/351
7,867,316 B2 * 1/2011 Jun et al. ..... 75/351
2008/0138643 A1 * 6/2008 Lee et al. ..... 428/570
2008/0159902 A1 * 7/2008 Shim et al. ..... 420/469
2009/0257907 A1 * 10/2009 Satoh et al. ..... 420/416

* cited by examiner

*Primary Examiner* — George Wyszomierski
(74) *Attorney, Agent, or Firm* — Singleton Law Firm, P.C.

(57) ABSTRACT

A method for the synthesis and manufacture of metal nanoparticles using metal inorganic salts. The method is simple and uses inexpensive chemicals. The procedure produces nanometals in 100% yields. Method is scalable and produces nanoparticles in unlimited quantities. In this method, a metal inorganic salt is dissolved in a reaction medium, comprised of a solvent and organic amine to create a metal/amine complex. A reducing agent, comprised of a solvent and Sodium Borohydride ($NaBH_4$), is then mixed with the metal/amine complex through titration or through a continuous flow process. The resulting nanoparticles are then precipitated through the addition of methanol and centrifugation and decanted. The decanted nanoparticles can then be suspended in a solvent for storage.

11 Claims, 6 Drawing Sheets

METHOD OF CONTROLLED SYNTHESIS OF NANOPARTICLES

FEDERALLY SPONSORED RESEARCH OR DEVELOPMENT

Not Applicable

CROSS-REFERENCES TO RELATED APPLICATIONS

Not Applicable

FIELD OF THE INVENTION

The present invention relates generally to a method of making metal nanoparticles, and more particularly, to a method of making metal nanoparticles from metal inorganic salt precursors.

BACKGROUND OF THE INVENTION

Nanotechnology is poised to be one of the primary technologies of the future. Nanoparticles, particles having a size of between 1 and 100 nm, find applications in various fields of research and industry. Nanoparticles are used as biomarkers, as catalysts, for drug delivery, as antibacterial materials, and in printable electronics, such as conductive inks.

In particular, metal nanoparticles are becoming important products in the chemical industry. The main reason for interest in nanometals between 1 to 50 nm in size is their high surface areas. It is estimated that 10% of metal atoms are on the surface for a particle with a 10 nm diameter. In comparison, 60% of the atoms are on the surface for a 2.5 nm size particle, R Bönnemann, R. M Richards, *Nanoscopic metal particles-synthetic methods and potential applications, Eur. J. Inorg. Chem.,* 2455-2480 (2001). Having such a high percentage of atoms exposed at the surface gives nanometals a distinct advantage over bulk materials. Nanometals are used as catalysts, antibacterial, agents, electrical conductors in printed circuits, sensors, magnetic materials, components of composites, components of fuel cells and biochemical analysis, and in many other areas and applications. Silver, copper, nickel, cobalt, gold, titanium, platinum, and iron nanoparticles are already in use. According to the Woodrow Wilson International Center for Scholars' "The Nanotechnology Consumer Products Inventory," published in March of 2006, there are already 212 nanoproducts on the consumer market. A large part of the market is occupied by nanosilver, which consists of 25 products. Only carbon nanotubes and fullerens have more products, 29, on the market. Nanosilver is used in anti-wrinkle and antibacterial clothes (soldier underpants, socks), antibacterial wound dressing, water treatment, and electrical contacts.

Another advantage of nanoparticles is that they provide the same or better quality of product using less material. For example, using nanoparticles in the production of printable electronics results in less material being used. Lines for printed circuits are thinner (0.1-0.5 micron compared to approximately 10 microns in traditional techniques) and narrower (10-50 microns). Accordingly, this significantly reduces the material used on the printed circuit by approximately 10 times, resulting in lowered production cost. As the technology opens up new market opportunities with greater demand and material purchases, the electronics industry will continue seeking low cost raw materials to support new applications.

Potentially, metal nanoparticles can replace large size particles in many applications. Thus, consumers will receive the same or better quality product, using smaller amounts of materials, resulting in lower costs.

Currently, nanometals are produced in small quantities by reduction of metal salts in water or organic solutions. Particles obtained using these techniques normally have consistent size distributions, but the size is typically large (greater than 20 nm) and not well controlled.

A variety of techniques have been proposed, and/or reduced to practice, for the synthesis of nanoparticles, including: arrested precipitation in solutions, synthesis in structured medium, high temperature pyrolysis, sonochemical and radiochemical methods and others. See A. P. Alivisatos, *Perspectives on the Physical Chemistry of Semiconductor Nanocrystals, J. Phys. Chem.* 100(31), 13226-13239 (1996); A. Eychmuller, *Structure and Photophysics of Semiconductor Nanocrystals, J. Phys. Chem.* 104(28), 6514-6528 (2000); C. B. Murray, C. R. Kagan, M. G. Bawendi, *Synthesis and Characterization of Monodisperse Nanocrystals and Close-Packed Nanocrystal Assemblies, Ann. Rev. Mater. Sci.* (30), 545-610 (2000); M. Green, P. O'Brien, *Recent Advances in the Preparation of Semiconductors as Isolated Nanometric Particles: New routes to Quantum Dots, Chem. Commun.,* 2235-2241 (1999); T. Trindadae, P. O'Brien, N. L. Pickett, *Nanocrystalline Semiconductors: Synthesis, Properties and Perspectives, Chem. Mater.* 13, 3843-3858 (2001). Current industrial technologies for the production of nano-oxides and nanometals in large quantities involve high temperature preparation of particles in a gas phase, without surfactants to stabilize particles during the growth. Rather, nanometals are produced in the gas phase by vacuum evaporation techniques and then stabilized in solution using standard surfactants. As a result, nanoparticles created using these methods tend to agglomerate, their shelf life is limited, and the shapes and the sizes of nanoparticles are not well controlled. These particles can be stabilized after suspending them in solution using surfactants and ultrasonic irradiation for dispersion of aggregates. This procedure does not greatly change the size and shape, but improves the stability of particles in solution.

Solution synthesis of metal nanoparticles dates back to 1857 when Faraday published a paper on the synthesis of zero-valent metals by reduction in the presence of surface stabilizing agents. This method has become prevalent since that time, and modifications are aimed at the improvements to the size control and size distribution of nanoparticles. Metal colloids are considered to be "monodisperse" if the size distribution deviates less than 15% from the average size value. "Narrow size distribution" usually means that the particle size histogram has a standard deviation, $\sigma$, smaller than 20%. Typically, the size distribution is not very good for particles produced using a solution method at low temperatures. Therefore, size selection methods are necessary to achieve the desired nanoparticle quality, see H. Bönnemann, R. M Richards, *Nanoscopic metal particles-synthetic methods and potential applications, Eur. J. Inorg. Chem.,* 2455-2480 (2001). The "citrate" method, developed by Wilcoxon and Brust, Wilcoxon, J. P., Williamson, R. L., Baughman, R., *Optical Properties of Gold Colloids Formed in Inverse Micelles, J. Chem. Phys.* 98, 9933-9950; Brust, M., Walker, M., Bethel, D., Schiffrin, D. J., Whyman, R., *J. Chem. Soc., Chem Commun.,* 801-802 (1994), produces good quality nanoparticles, but it is restricted to using water as a solvent and it is unable to produce a high concentration of nanometal in solution. Currently, the best technique for producing high-quality semiconductor quantum dots, nano-oxides, and nanometals is a high temperature pyrolysis of precursors in high boiling point solvents. See A. P. Alivisatos, *Perspectives on the Physical Chemistry of Semiconductor Nanocrystals, J. Phys. Chem.* 100(31), 13226-13239 (1996); A. Eychmuller, *Structure and Photophysics of Semiconductor Nanocrystals, J. Phys. Chem.* 104(28), 6514-6528 (2000); C. B. Murray, C. R. Kagan, M. G. Bawendi, *Synthesis and Characterization of Monodisperse Nanocrystals and Close-Packed Nanocrystal Assemblies, Ann. Rev. Mater. Sci.* (30), 545-610 (2000); M. Green, P. O'Brien, *Recent Advances in the Preparation of Semiconductors as Isolated Nanometric Particles: New routes to Quantum Dots, Chem. Commun.,* 2235-2241 (1999); T. Trindadae, P. O'Brien, N. L. Pickett, *Nanocrystalline Semiconductors: Synthesis, Properties and Perspectives, Chem. Mater.* 13, 3843-3858 (2001).

There are many variants of this organometallic route, and great progress has been achieved in the synthesis of semiconductor quantum dots. The synthesis of cadmium chalcogenides is the best developed and produces highly fluorescent nanoparticles with a narrow size distribution. Work on the synthesis of nanometals is in progress and some synthetic procedures are described below.

Pyrolysis of metal carbonyls has been used for the production of metal nanoparticles like cobalt, iron, nickel, and others, but with a relatively large size distribution, see V. F. Puntes, K. M. Krishnan, A. P. Alivasatos, *Colloidal Nanocrystal Shape and Size Control: The Case of Cobalt, Science* 291, 2115-2117 (2001). Careful control of the ligands' nature and the combination of surfactants improve control of the size distribution, C. S. Samia, K. Hyzer, J. A Schlueter, C. J. Qin, J. S. Jiang, S. D. Bader, X. M. Lin, *Ligand Effect on the Growth and the Digestion of Co Nanocrystals, J. Am. Chem. Soc.* 127, 4126-4127 (2005). Other approaches use a weaker reducing agent and a more stable precursor. Using this method, see S. SD. Bunge, T. J. Boyle, T. J. Headley, *Synthesis of Coinage-Metal Nanoparticles from Mesityl Precursors, Nano Lett.* 3, 901-905 (2003), copper, silver, and gold mesityl complexes were dissolved in octylamine and then subsequently injected in hot (300° C.) hexadecylamine. This method uses expensive precursors and is not suitable for large scale production.

In another paper, see N. R. Jana, X. Peng, *Single-Phase and Gram-Scale Routes Toward Nearly Monodisperse Au and Other Noble Metal Nanocrystals, J. Am. Chem. Soc.* 125, 14280-14281 (2003), gold chloride, silver acetate, copper acetate, or platinum chloride was dissolved in toluene with ammonium surfactant. Either tetrabutylammonium borohydride or its mixture with hydrazine in toluene was used as the reducing agent. Fatty acids or aliphatic amines served as ligands. The drawback of their approach is that authors of paper used expensive chemicals as solvents, didodecyldimethylammonium bromide, lengthy and complicated procedures, including sonication to allow dissolution of precursors.

Hiramatsu and Osterloh, see H. Hiramatsu, E. Osterloh, *A Simple Large-Scale Synthesis of Nearly Monodisperse Gold and Silver Nanoparticles with Adjustable Sizes and with Exchangeable Surfactants, Chem. Mater.* 16, 2509-2511 (2004), described an inexpensive and reproducible method for the synthesis of organoamine stabilized gold and silver nanoparticles in the 6-21 nm (gold) and 8-32 nm (silver) size ranges with polydispersities as low as 6.9%. Their procedure requires only three reagents: tetrachloroauric acid or silver acetate, oleylamine, and a solvent. The reaction proceeds in 2 hours in toluene under refluxing and produces good quality gold or silver nanoparticles. This procedure however requires lengthy time and heating.

NanoMas Technologies, owner of the rights to Pub. No.: WO/2007/120756, 25 Oct. 2007, disclosing the method of synthesis of silver nanoparticles in a two-phase system, where silver acetate is dissolved in organic solvent (toluene) and sodium borohydride is dissolved in water. Then sodium borohyrdide is added to silver precursor and the reaction mixture is stirred for 2.5 hours. The water phase, is removed by separation funnel and toluene is concentrated by rotor-evaporator. Then silver nanoparticles are precipitated by addition of methanol. Their procedure includes the presence of water in the reaction mixture, which can absorb on the surface of nanosilver and deteriorate its properties. The procedure is tedious and includes undesirable steps, like water separation, etc. Silver acetate is used as a silver precursor, which is more expensive than silver nitrate.

Xerox, owner of the rights to US Patent Application 20060073667 disclosing a method of synthesis which includes dissolving, at 60 C, silver acetate in toluene in the presence of dodecylamine as surfactant and then adding phenylhydrazine to the mixture. The solution is kept at 60 C for 1 hour and then cooled down. This procedure is lengthy, includes expensive silver precursor, and heating. Dodecylamine is not a good surfactant as it does not provide long-term stability for the silver nanoparticles.

OBJECTS AND ADVANTAGES

The method disclosed herein uses low cost materials for the synthesis of nanometals: inorganic salts as metal precursors, oleylamine as a surfactant, and typical chemical solvents, toluene or ethanol. Water is avoided in the synthesis as it deteriorates properties of the final product. Our method is scalable and can produce high quality nanoproducts in continuous regimen in essentially unlimited quantities with nearly 100% yield. Another advantage is that the method disclosed herein does not require heating and other tedious and expensive steps.

SUMMARY OF THE INVENTION

This invention is devoted to the synthesis of metal nanoparticles in organic solvents using inexpensive chemicals and simple procedures. In accordance with the embodiments of this invention, nanoparticles having an average the size of 25 nm or less are formed by reducing the metal precursor in the presence of surfactant, preferably, the long chain amine oleylamine.

Our reaction media (solvents) are also inexpensive. They include ethanol, toluene, xylenes, or other typical chemical solvents. The reaction media also include organic amines which improve the solubility of inorganic salts by forming metal/organic complexes. These organic amines can also serve as surface stabilizers of nanometals. Specifically, oleylamine is used as a surfactant, which stabilizes nanoparticles during the particles growth and provides long shelf lifetime of nanometals.

The procedure in this method is simple and universal and consists of dissolving a metal precursor, comprised of a metal inorganic salt with a reaction medium (with said reaction medium comprising a solvent and an organic amine selected from the group of aliphatic or aromatic amines or amides) to create a metal/amine complex.

Separately, a reducing agent is created comprising a solvent and sodium borohydride.

The reducing agent is then either pumped into the metal/amine complex through titration, in the batch method, or the metal/amine complex and reducing agent are simultaneously pumped into a reactor, under vigorous stirring, in the continuous flow method.

It is understood for those skilled in the art that the mixing can be performed using various industrial techniques. This scale-up process can be used for production of various materials, with almost 100% yield and the production can be scaled-up to large scale. The only requirement is sufficient mixing of the metal/amine complex and reducing agent at the entrance of the reactor.

DETAILED DESCRIPTION OF THE PREFERRED EMBODIMENTS

Figure 1:
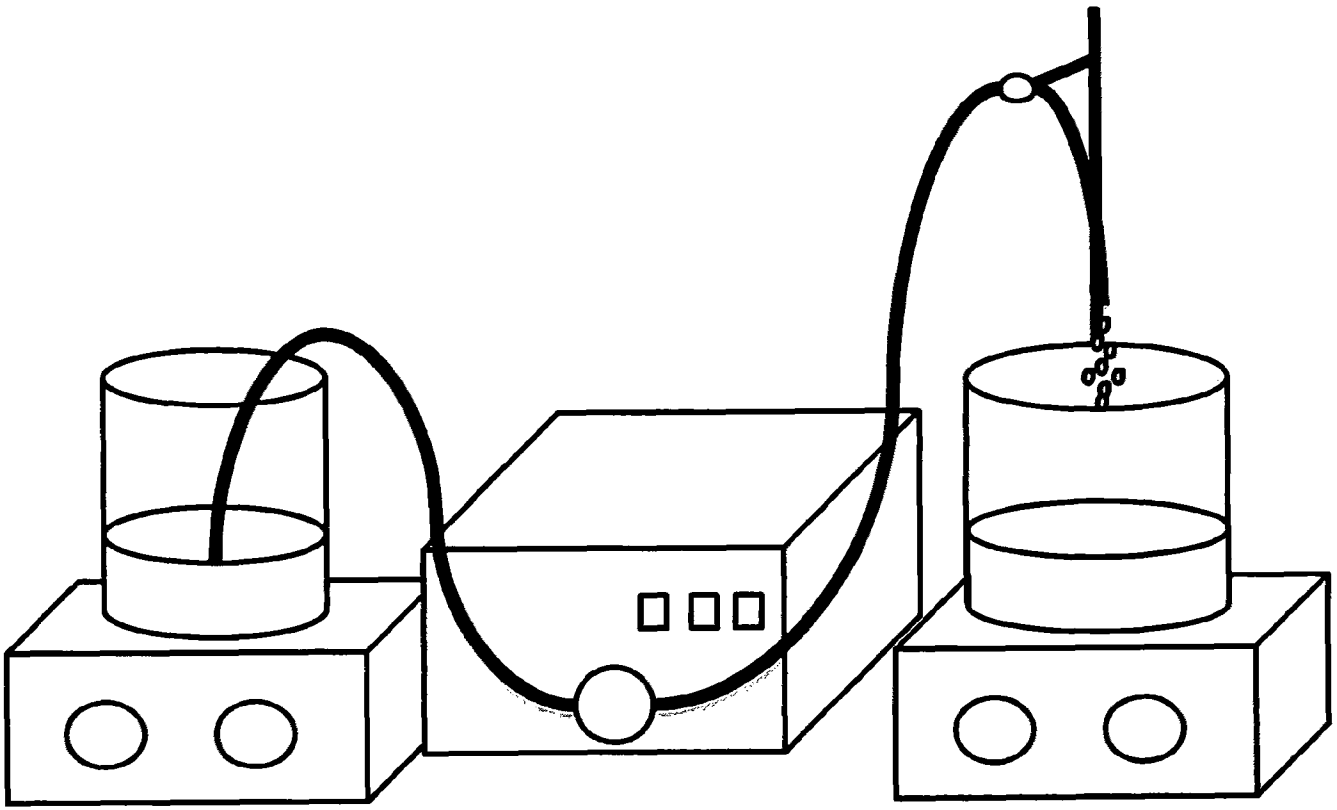
FIG. 1 illustrates the apparatus for the synthesis of metal nanoparticles on small scale in accordance with a preferred embodiment of the present invention.

The present invention is related to the method of synthesis and large scale manufacturing of metal nanoparticles. The method uses inexpensive chemicals and thus can be used for large scale production of colloidal nanoparticles for future technology needs.

Using the process of the present invention, copper, silver, gold, and platinum nanoparticles were synthesized at room temperature with high yield and quality. While the method disclosed herein has been reduced to practice in the creation of copper, gold, platinum, and silver nanoparticles, the method is appropriate for the synthesis of various other nanometals as well.

The size of nanoparticles can be controlled by changing the ratio of metal precursor to surfactant, the nature of surfactant, the solvent, the ratio of metal precursor to sodium borohyrdide, and other parameters of the reaction mixture and conditions of the synthesis.

In accordance with preferred embodiment of this invention, a metal precursor is a simple inexpensive inorganic salt of metal, for example, but not limited to, silver nitrate ($AgN0_3$), gold trichloride ($AuCl_3$), copper chloride ($CuCl_2$), or platinum chloride ($PtCl_2$).

In order to improve solubility of metal precursor in organic solvents, such as toluene or ethanol, an organic amine, such as oleylamine, is added to the solvent to produce the reaction medium. This organic amine also serves as a surfactant during the synthesis of the nanoparticles.

In one embodiment of the invention, polymers may be added to the reaction medium in order to prepare the nanoparticles in polymer solutions. These nanoparticles in polymer can form solid polymers with embedded nanoparticles after solvent evaporation, which can find various applications, like antibacterial, optical products, and others.

The metal precursor is combined with the reaction medium under vigorous stirring to create the metal/amine complex.

In accordance with a preferred embodiment of the invention, the reducing agent is a solution of sodium borohydride ($NaBH_4$) in 200 proof ethanol.

In accordance with the embodiments of the invention, nanoparticles can be synthesized on small scale in a beaker, the batch method, and on a large scale, the continuous flow method.

In one preferred embodiment, the "batch method," the metal/amine complex is titrated by the reducing agent under vigorous stirring to produce colloidal metal nanoparticles.

In another preferred embodiment, the "continuous flow method" the metal/amine complex and reducing agent are simultaneously pumped into a reactor, stirred vigorously, and collected at the end of the reactor as colloidal nanoparticles. The flow rate of the metal precursor and the sodium borohydride precursor can be increased in order to increase the production rate. The increase in flow rates requires larger diameter reactors in order to obtain the same quality of the product with higher yield.

After synthesis, the colloidal nanoparticles can be isolated from the solution by precipitation with methanol and centrifugation. The colloidal nanoparticles can be separated from the solution by the number of precipitation and centrifugation steps until the desired purity of the product is achieved.

In accordance with the embodiments of the invention, the nanoparticles can be dissolved in a suitable solvent for specific applications after purification steps. It can be hexane, toluene, xylenes, diethylbenzene, terpineol, tetralin, decalin, and any other solvent suitable for nanometals applications.

FIG. 1 illustrates an apparatus for the synthesis using the batch method in accordance with the embodiments of the invention. The solution of metal precursor in an appropriate solvent stirred in a beaker or a flask. The reducing agent, sodium borohyrdide, is added continuously through a small tube with the preferable flow rate ranging from 1 ml/min to 10 mL/min. The process can be periodically checked by measuring absorbance of the liquid in the beaker. With the passage of time, the absorbance of product increases to some point and then stops increasing. The end of the process is characterized by the decrease of the intensity of absorbance and by broadening of the absorbance spectrum.

Figure 2:
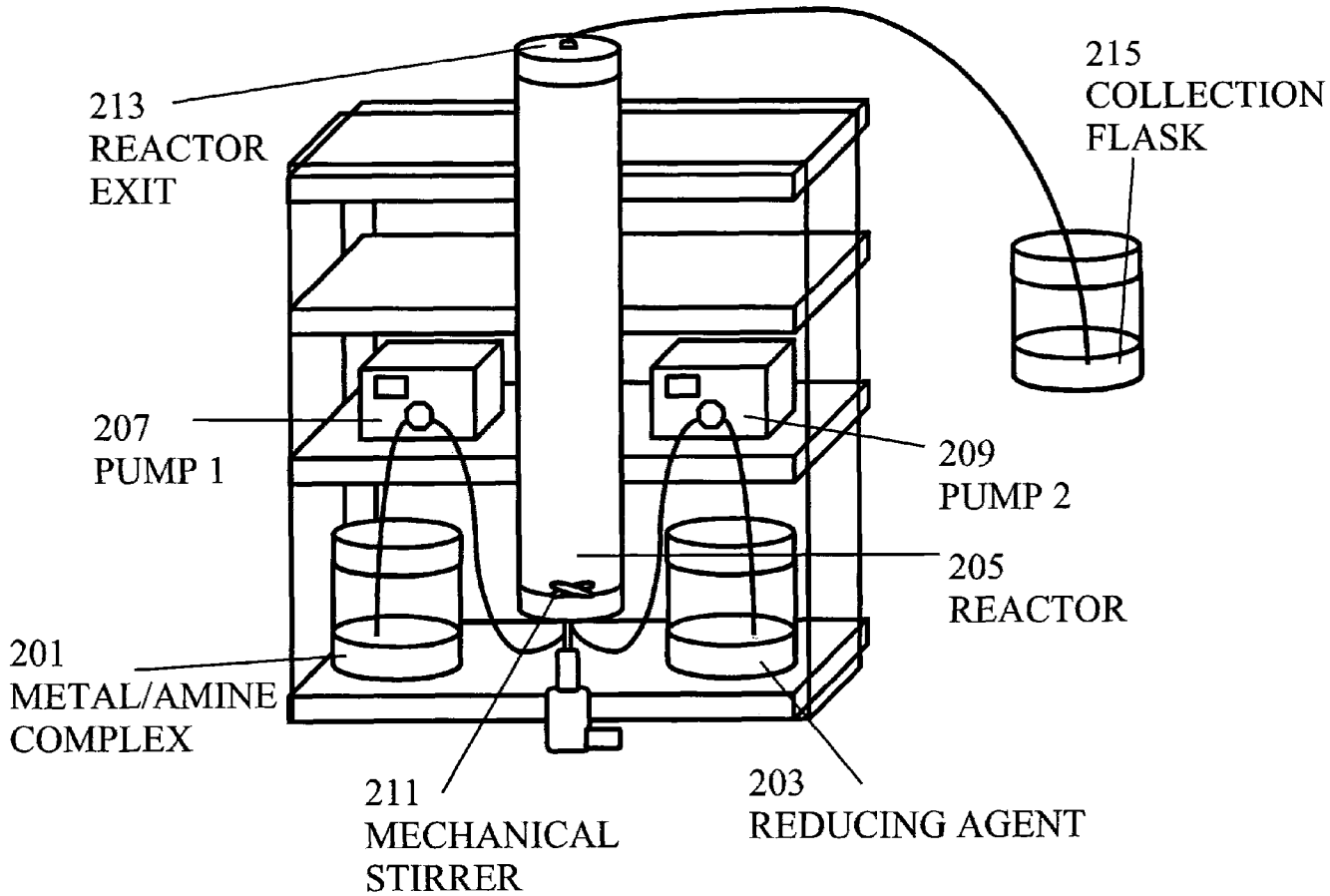
FIG. 2 illustrates the continuous-flow system for the synthesis of nanoparticles on a large scale in accordance with a preferred embodiment of the present invention.

FIG. 2 illustrates an apparatus for synthesis of nanoparticles using the continuous flow method in accordance with the embodiments of the invention. The solution of metal precursor and sodium borohydride solution are pumped into the reactor at the ratio of flow rates which provides the same ratio of metal precursor to reducing agent as with the batch method. The product is collected at the exit of the reactor and further centrifuged and redissolved in appropriate solvent. It also can be purified as described in examples section set forth below. The product can also be further centrifuged directly after synthesis by using separation equipment embedded in the process line. It will be understood for those skilled in the art that the flow rate of the metal precursor and the sodium borohydride precursor can be increased in order to increase the production rate. The increase in flow rates will require larger diameter reactors in order to obtain the same quality of the product with higher yield.

The invention will now be described in detail with respect to specific exemplary embodiments thereof, it being understood that these examples are intended to be illustrative only and the invention is not intended to be limited to the materials, conditions, or process parameters recited herein. In particular, it will be understood by those skilled in the art that method disclosed herein is not limited to the creation of the specific nanoparticles disclosed in the examples, but that the method may also be used to create various other nanometals as well. The following examples occurred at room temperature.

EXAMPLES

Example 1

Synthesis of Silver Nanoparticles

Synthesis of Silver Nanoparticles from Ethanol Solution.

10 g of silver nitrate ($AgNO_3$) was dissolved in a reaction medium consisting of 60 ml of 200 proof ethanol and 83 ml of oleylamine under vigorous stirring to create the metal/amine complex. Separately, 0.8 g of sodium borohydride ($NaBH_4$) was dissolved in 200 ml of 200 proof ethanol to create the reducing agent. The sodium borohydride reducing agent was slowly pumped at different flow rates (from 2 ml/min to 10 ml/min) into the metal/amine complex under vigorous stirring. FIG. 1 illustrates the apparatus used in the synthesis in the batch process.

When the flow rate of sodium borohydride of 5 ml/min was used, the reaction was typically stopped after thirty-five minutes. The reaction was controlled by UV/V is absorbance by measuring spectra every three to five minutes. The peak intensity of silver increased with time. Typically the peak became narrower after ten to twenty-five minutes of titration. Thereafter, the peak position shifted to shorter wavelengths (from approximately 416 nm to approximately 406 nm). After a certain period of time, typically thirty minutes, the intensity of absorbance stopped increasing and the peak became broader. This indicated that the reaction had reached its end. The yield rate of silver nanoparticles is approximately 100%, yielding approximately 6 g of silver nanoparticles. The stirring continued for additional three to five minutes, then stopped to let silver nanoparticles precipitate.

Isolation of Particles.

Figure 3:
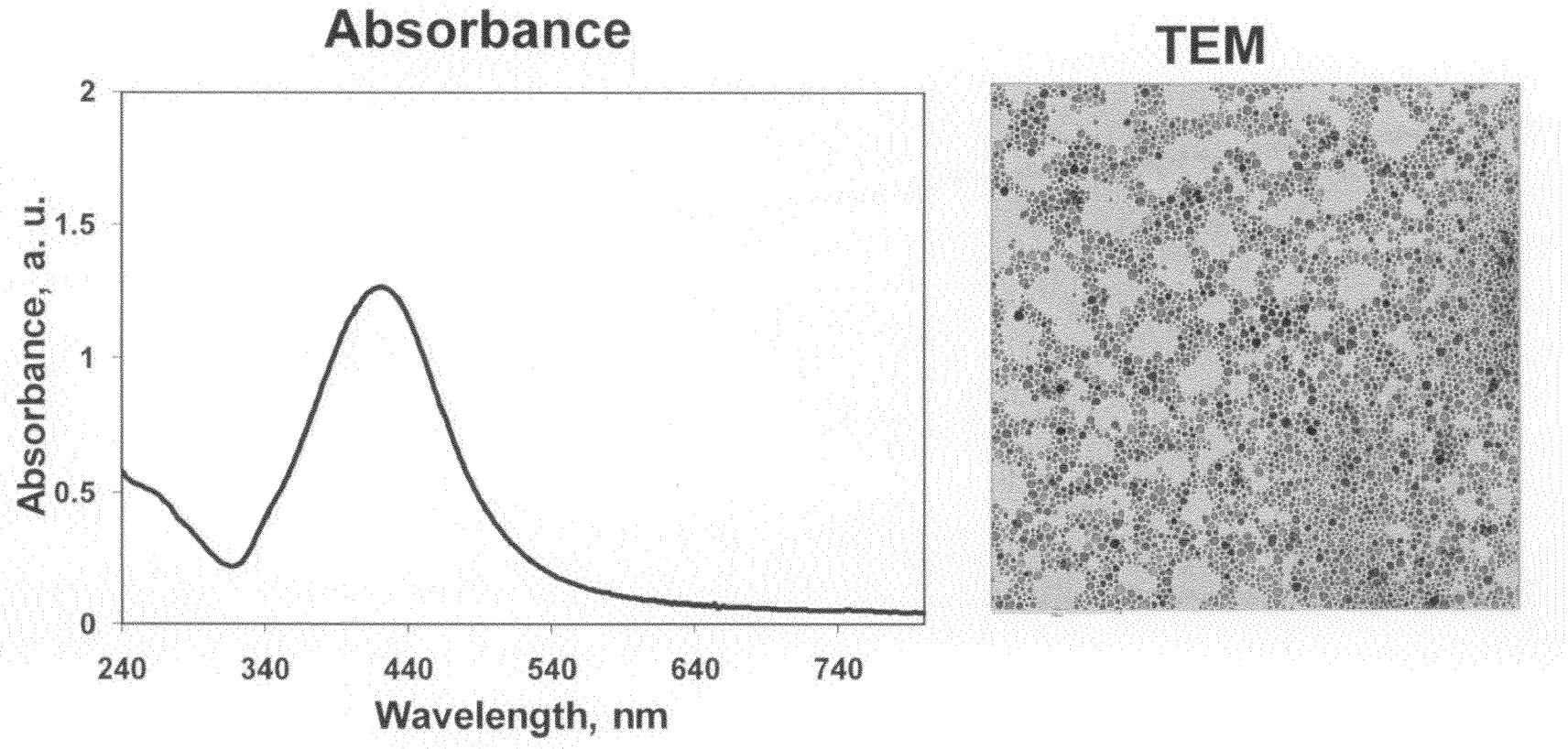
FIG. 3 illustrates the absorbance and TEM of silver nanoparticles in accordance with a preferred embodiment of the present invention.

The precipitated silver nanoparticles were centrifuged at 2500 rpm for five minutes. The solvent was then decanted and can be recycled by roto-evaporation or other means. The precipitate can be redissolved in an appropriate solvent: hexane, toluene, xylenes, etc. The obtained nanoparticles can be further purified by precipitation with methanol and further centrifugation. The final product was dissolved in a nonpolar solvent. Absorbance and TEM of silver nanoparticles are shown in FIG. 3.

Synthesis of Silver Nanoparticles from Toluene Solution.

The procedure is similar to the Synthesis of Silver Nanoparticles from Ethanol Solution, above, except that toluene was used as a solvent in the place of ethanol in the reaction medium. Silver nitrate dissolved well in toluene in the presence of oleylamine. Purification and isolation of particles was the same as in Synthesis of Silver Nanoparticles from Ethanol, above.

Large Scale Production of Silver Nanoparticles in Continuous Liquid Flow

FIG. 2 shows a set-up of the system for a continuous production of nanometals. The concentrations of precursors for the synthesis in this flow system was the same as for small scale batch process as described above in Synthesis of Silver Nanoparticles from Ethanol Solution. 250 g of silver nitrate was dissolved in a reaction medium consisting of 2 L of oleylamine and 18 L of ethanol, under vigorous stirring to create the metal/amine complex 201. 45 g of sodium borohyrdide was dissolved in 8 L of 200 proof ethanol to create the reducing agent 203. The metal/amine complex was delivered to the reactor 205 by one pump 207 and the reducing agent was delivered to the reactor by another pump 209. The flow rate of silver precursor was 250 ml/min and the reducing agent was pumped at 100 ml/min. Both the metal/amine complex and reducing agent solutions entered the reactor at the bottom of the reactor and were strongly mixed by mechanical stirrer 211 at a rate between 800 to 2800 rpm. Fast stirring accelerated the reaction rate of precursors at the entrance of the reactor and provided high quality nanoparticles. The nanoparticles were collected at the reactor exit 213. The length of the reactor should be long enough to complete the reaction. The nanoparticles in solution were then collected in the collection flask 215. The yield of the nanoparticles in this arrangement was typically complete, between 90 and 100%. Accordingly, the synthesis, under the conditions described above, produced approximately 130 to 140 grams of silver nanoparticles. It would be understood to those skilled in the art that this production can extended to an even larger scale using faster liquid flow, higher concentrations of precursors, and larger reactors. It would also be understood to those skilled in the art that the reagents can enter the reactor at different positions of the reactor, vertical or horizontal or under an angle, and that the rate of mixing can be at either a lower or higher rate. The ratio of flow rates of the metal/amine complex and reducing agent can also be changed and adjusted in order to get the best yields and quality of the products.

Example 2

Synthesis of Gold Nanoparticles from Toluene Solution

Figure 4:
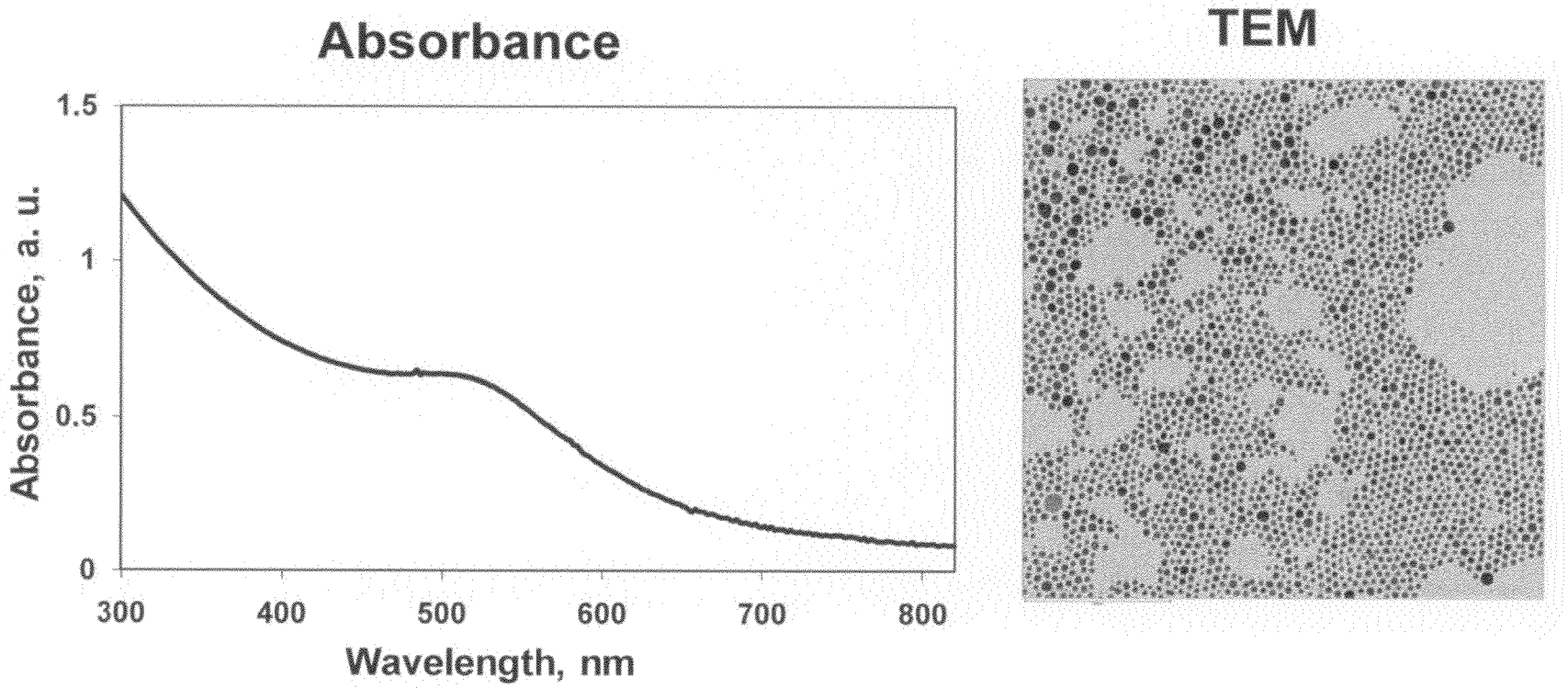
FIG. 4 illustrates the absorbance and TEM of gold nanoparticles in accordance with a preferred embodiment of the present invention.

The synthesis of gold nanoparticles was performed under conditions similar to the previously described nanoparticles. 15.6 g of gold trichloride or tetrachlorohydroauric acid was dissolved in 80 ml of oleylamine and 290 ml of toluene under vigorous stirring to create the metal/amine complex. Separately 2.2 g of $NaBH_4$ was dissolved in 500 ml of 200 proof ethanol to create the reducing agent. The reducing agent was pumped at 5 ml/min into the metal/amine complex. Total reaction time was 56 min. The process was controlled by UV/V is absorbance. After the synthesis, methanol was added to allow gold nanoparticles precipitate. Particles were isolated and purified by centrifugation similar to silver nanoparticles. Absorbance and TEM of gold nanoparticles are shown in FIG. 4.

The synthesis of gold nanoparticles was also conducted utilizing the continuous flow method as described above.

Example 3

Synthesis of Platinum Nanoparticles from Ethanol Solution

The synthesis of gold nanoparticles was performed under conditions similar to the previously described nanoparticles. 0.5 g of $PtCl_2$ was dissolved in 6.2 mL of oleylamine and 83 mL of 200 proof ethanol to create the metal/amine complex. The metal/amine complex was stirred at room temperature for approximately one hour until the Pt salt dissolves. In a separate flask 0.9 g of Sodium Borohydride was dissolved in 200 mL of 200 proof ethanol to create the reducing agent.

The metal/amine complex was titrated with the reducing agent at 5 ml/min flow rate. The titration was stopped after twenty minutes. The resulting solution was centrifuged and then redissolved in appropriate solvent, typically hexane or toluene.

Figure 6:
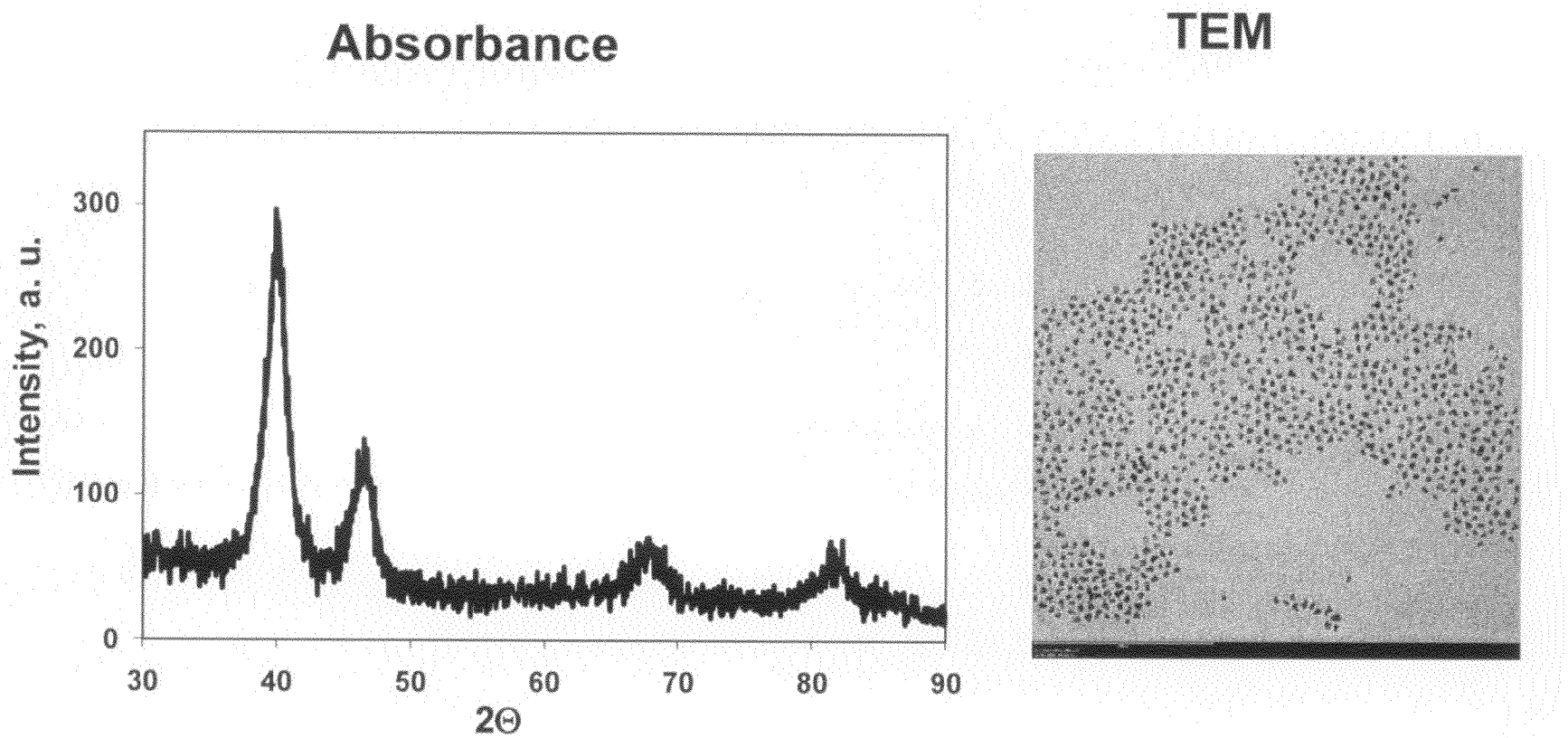
FIG. 6 illustrates the powder diffraction and TEM of platinum nanoparticles in accordance with a preferred embodiment of the present invention.

This reaction produced platinum nanoparticles approximately 5 to 10 nm in size. TEM and powder diffraction of platinum nanoparticles are shown in FIG. 6.

Toluene was also used as a solvent in the reaction medium for the synthesis of platinum nanoparticles.

The synthesis of platinum nanoparticles was also conducted utilizing the continuous flow method as described above.

Example 4

Synthesis of Copper Nanoparticles from Toluene Solution

The synthesis of copper nanoparticles was performed under conditions similar to the previously described nanoparticles, except that the synthesis was performed under an argon atmosphere. The synthesis of copper nanoparticles took place in a 3-necked flask. Inlet and outlet for argon were fixed through Teflon adapters over two of the necks and in the central neck a glass inlet containing a flexible tube from a syringe pump was fixed through a Teflon adapter.

0.2 g of copper chloride was dissolved in 4.9 mL of oleylamine and 60 mL of toluene in a 3-necked flask to create the metal/amine complex. The metal/amine complex was kept stirring under the argon atmosphere for one hour.

In another 3-necked flask, 225 mg of sodium borohydride was added along with 20 mL of 200 proof ethanol to create the reducing agent. The third neck of this flask was kept closed with a septum. This flask was also kept stirring under an argon atmosphere for one hour.

Figure 5:
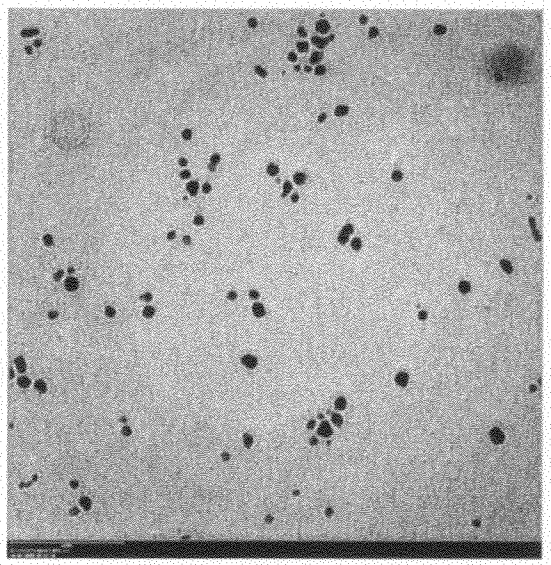
FIG. 5 illustrates the absorbance and TEM of copper nanoparticles in accordance with a preferred embodiment of the present invention.
Figure 5:
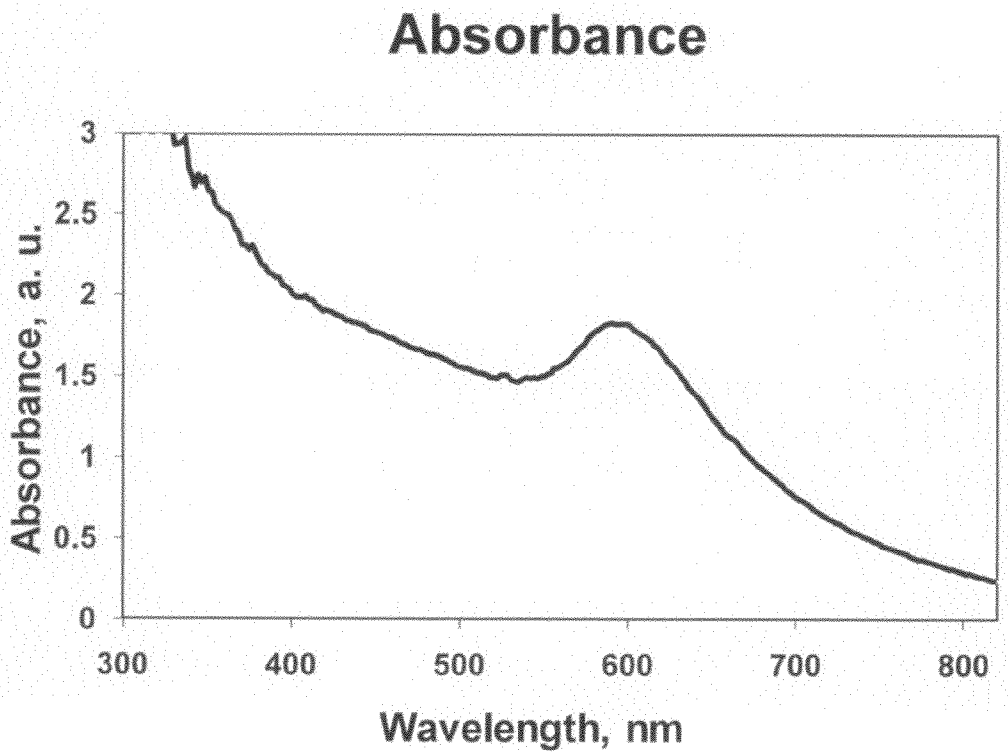

The reducing agent was pumped into metal/amine complex through a syringe pump at a rate of 0.5 ml/minute. The addition of the reducing agent continued for 30 minutes. During the addition, the color of the solution in the flask changed gradually, between four to eight minutes, from blue (through sea blue, green, yellow, brown, reddish brown colors) to a dark reddish black color. Absorption spectrum of samples immediately after the color change (approximately ten minutes) did not show any peak with good features. But the absorption spectrum of samples anytime after twenty five minutes showed a broad peak at wavelengths between 586 nm and 594 nm. The feature of the peak slightly improved if the contents were stirred for an hour after the addition of the reducing agent to the metal/amine complex was completed. Absorbance and TEM of copper nanoparticles are shown in FIG. 5.

Isolation and purification of copper nanoparticles is similar to silver nanoparticles, except that solvents should be, and were, degassed by argon before purification.

Toluene was also used as a solvent in the reaction medium for the synthesis of copper nanoparticles.

The synthesis of copper nanoparticles was also conducted utilizing the continuous flow method as described above.

The invention being just described should be considered as general approach and the foregoing examples are not intended to limit the scope of the invention, in particular the nanometals produced in the examples. It is apparent for those skilled in the art that the same maybe varied in many ways. Such variations are not to be regarded as a departure from the spirit and the scope of invention. Rather all such modifications are intended to be included within the scope of following claims.

The invention claimed is:

1. A method of making silver nanoparticles, comprising:
(a) dissolving $AgNO_3$ in a reaction medium, comprising ethanol and oleylamine, to form a metal/amine complex;
(b) combining a reducing agent, comprising $NaBH_4$ and ethanol, with the metal/amine complex at a rate of between 2 ml/min to 10 ml/min to form silver nanoparticles in solution;
(c) adding methanol to form a precipitate; and
(d) separating the precipitate to form silver nanoparticles.

2. The method of claim 1, wherein said reaction medium is comprised of toluene and oleylamine.

3. The method of claim 1, wherein the combination of metal/amine complex and reducing agent is performed by a continuous process in a continuous flow apparatus wherein said metal/amine complex and reducing agent are pumped by individual pump and combined in a continuous flow reactor.

4. A method of making gold nanoparticles, comprising:
(a) dissolving $AuCl_3$ in a reaction medium comprising toluene and oleylamine to form a metal/amine complex;
(h) combining a reducing agent, comprising $NaBH_4$ and ethanol, with the metal/amine complex at a rate of 5 ml/min to form gold nanoparticles in solution;
(c) adding methanol to form a precipitate; and
(d) separating the precipitate to form gold nanoparticles.

5. The method of claim 4, wherein the combination of metal/amine complex and reducing agent is performed by a continuous process in a continuous flow apparatus wherein said metal/amine complex and reducing agent are pumped by individual pump and combined in a continuous flow reactor.

6. A method of making platinum nanoparticles, comprising:
(a) dissolving $PtCl_2$ in a reaction medium, comprising toluene and oleylamine, to form a metal/amine complex;
(b) combining a reducing agent, comprising $NaBH_4$ and ethanol, with the metal/amine complex at a rate of 5 ml/min to form platinum nanoparticles in solution;
(c) adding methanol to form a precipitate; and
(d) separating the precipitate to form platinum nanoparticles.

7. The method of claim 6, wherein said reaction medium is comprised of ethanol and oleylamine.

8. The method of claim 6, wherein the combination of metal/amine complex and reducing agent is performed by a continuous process in a continuous flow apparatus wherein said metal/amine complex and reducing agent are pumped by individual pump and combined in a continuous flow reactor.

9. A method of making copper nanoparticles, comprising:
(a) under an Argon atmosphere, dissolving $CuCl_2$ in a reaction medium, comprising toluene and oleylamine, to form a metal/amine complex;
(b) under an Argon atmosphere, combining a reducing agent, comprising $NaBH_4$ and ethanol, with the metal/amine complex at a rate of 5 ml/min to form copper nanoparticles in solution;
(c) adding methanol to form a precipitate; and
(d) separating the precipitate to form copper nanoparticles.

10. The method of claim 9, wherein said reaction medium is comprised of ethanol and oleylamine.

11. The method of claim 9, wherein the combination of metal/amine complex and reducing agent is performed by a continuous process in a continuous flow apparatus wherein said metal/amine complex and reducing agent are pumped by individual pump and combined in a continuous flow reactor.

* * * * *